US005480006A

United States Patent [19]

Kameli et al.

[11] Patent Number: 5,480,006

[45] Date of Patent: Jan. 2, 1996

[54] ELEVATOR DOWNPEAK SECTORING

[75] Inventors: Nader Kameli, Cromwell; James M. Collins, Farmington, both of Conn.

[73] Assignee: Otis Elevator Company, Farmington, Conn.

[21] Appl. No.: 291,529

[22] Filed: Aug. 8, 1994

Related U.S. Application Data

[63] Continuation of Ser. No. 92,676, Jul. 16, 1993, abandoned.

[51] Int. Cl.[6] ..... B66B 1/20

[52] U.S. Cl. ..... 187/383; 187/387

[58] Field of Search ..... 187/380, 382, 187/383, 387, 385

[56] References Cited

U.S. PATENT DOCUMENTS 3,610,370 10/1971 Suozzo ..... 187/128
4,401,190 8/1983 Bittar ..... 187/29 R
4,492,288 1/1985 Schroder ..... 187/128
4,792,019 12/1988 Bittar et al. ..... 187/125
5,020,642 6/1991 Tsuji ..... 187/124
5,035,302 7/1991 Thangavelu ..... 187/125
5,202,540 4/1993 Auer et al. ..... 187/101
5,317,114 5/1994 Pullela et al. ..... 187/128

*Primary Examiner*—Peter S. Wong
*Assistant Examiner*—Robert Nappi

[57] ABSTRACT

During downpeak time period of an elevator system, cars are assigned to sectors of an approximately equal number of floors with remaining floors being assigned to sectors near the lobby, one car per sector. The invention provides a dispatching strategy for serving elevator traffic in both up and down directions, giving priority service to the down traveling traffic while providing limited service to the up traveling traffic. All floors requiring down service are given equal access to the system regardless of the position of the floor in the building.

5 Claims, 2 Drawing Sheets

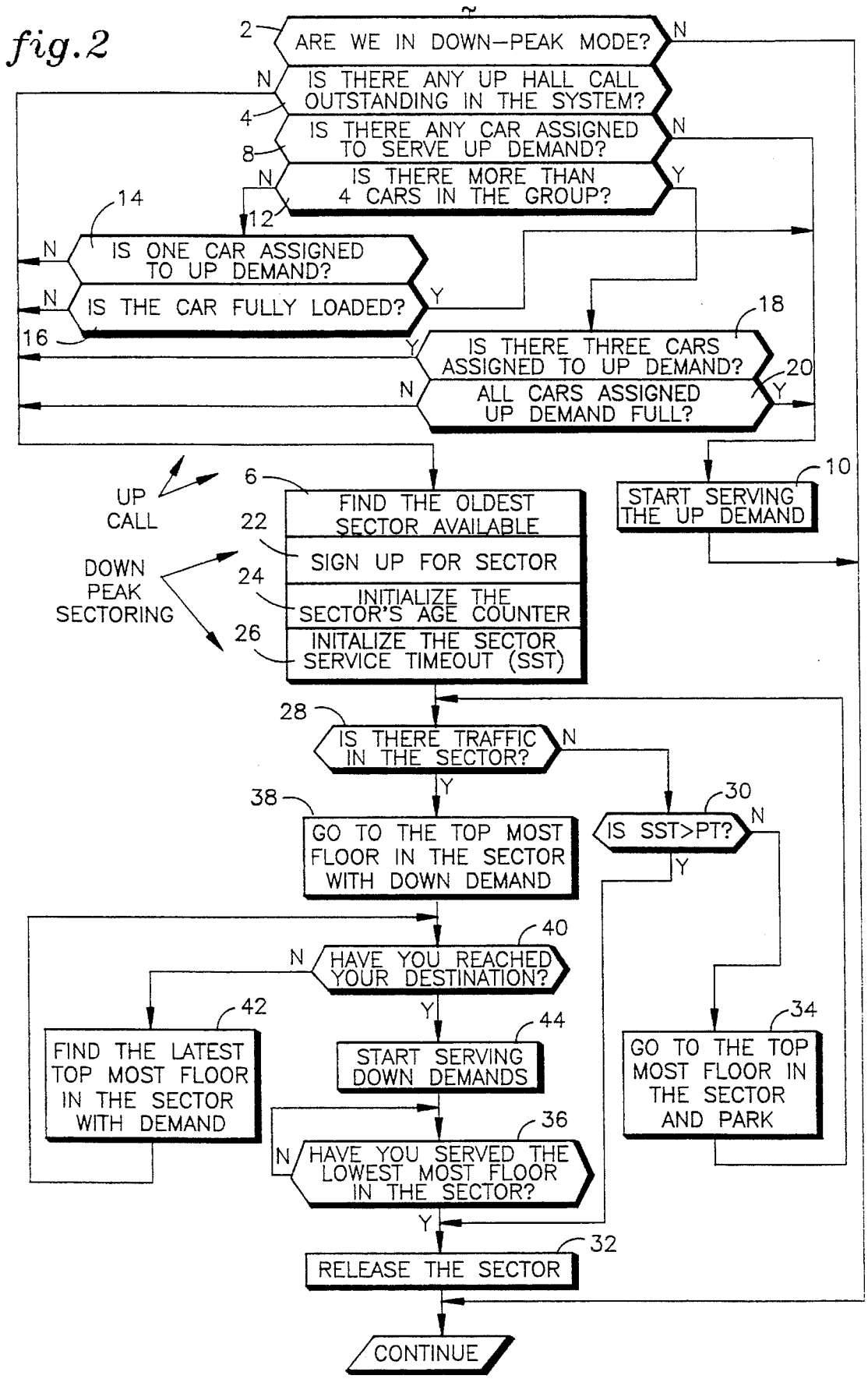
fig.2
2
ARE WE IN DOWN-PEAK MODE?
N
N
IS THERE ANY UP HALL CALL OUTSTANDING IN THE SYSTEM?
4
IS THERE ANY CAR ASSIGNED TO SERVE UP DEMAND?
N
8
N
IS THERE MORE THAN 4 CARS IN THE GROUP?
Y
14
12
N
IS ONE CAR ASSIGNED TO UP DEMAND?
N
IS THE CAR FULLY LOADED?
Y
18
16
Y
IS THERE THREE CARS ASSIGNED TO UP DEMAND?
20
N
ALL CARS ASSIGNED UP DEMAND FULL?
Y
UP CALL
6
FIND THE OLDEST SECTOR AVAILABLE
10
START SERVING THE UP DEMAND
22
SIGN UP FOR SECTOR
DOWN PEAK SECTORING
24
INITIALIZE THE SECTOR'S AGE COUNTER
26
INITALIZE THE SECTOR SERVICE TIMEOUT (SST)
28
IS THERE TRAFFIC IN THE SECTOR?
N
Y
38
GO TO THE TOP MOST FLOOR IN THE SECTOR WITH DOWN DEMAND
30
IS SST>PT?
N
Y
40
N
HAVE YOU REACHED YOUR DESTINATION?
42
FIND THE LATEST TOP MOST FLOOR IN THE SECTOR WITH DEMAND
Y
44
START SERVING DOWN DEMANDS
34
GO TO THE TOP MOST FLOOR IN THE SECTOR AND PARK
36
N
HAVE YOU SERVED THE LOWEST MOST FLOOR IN THE SECTOR?
Y
32
RELEASE THE SECTOR
CONTINUE

ELEVATOR DOWNPEAK SECTORING

This application is a continuation application of Ser. No. 08/092,676 filed Jul. 6, 1993, now abandoned.

TECHNICAL FIELD

The field of the present invention relates to dispatching elevator cars.

BACKGROUND OF THE INVENTION

Optimization of elevator systems take on the form of service time reduction, waiting time reduction, power consumption reduction, space usage reduction, etc.

In the area of service time reduction, there are different portions of the day having different service demands. For example, in the morning the traffic demand is mostly unidirection and in the upward motion; whereas, in the afternoon the traffic demand is the opposite. By changing the characteristics of the service, service can be improved by decreasing the waiting time and service time for the majority of the people demanding the service.

One of the special cases of service improvements is in regards to the down-peak traffic. Down-peak traffic is defined as the flow of traffic, usually in the afternoon, when a majority of the building population leave the building. The characteristics of this flow are such that people enter the cars at the upper floors and enter car calls which cause the car to move in the down direction and the destination, in almost all cases, is the lobby.

Currently, cars travel to the uppermost landing having a down hall call and start collecting people floor by floor as the car travels down. The problem with this operation is that during the down peak period, the demand for service is high; therefore, cars load up in most cases after the first three or four stops and almost in all cases load up before they reach the bottom third of the building. This results in large waiting times for the passengers in the lower section of the building. Using this method of operation, the elevator system services the building from top to bottom meaning the lower floors only get service if the upper floors are satisfied. This is called lower landing starvation.

DISCLOSURE OF THE INVENTION

The invention is predicated on the observation that the time spent by a passenger during a typical downpeak run can be broken into two major phases: a. waiting time at a floor and b. riding time in the car.

Waiting time reduction can be effected by elimination of the lower landing starvation problem. On the other hand, reduction of the number of car stops a car makes after it picks up a passenger is important for reducing a passenger's riding time.

One way to achieve both objectives of reducing the number of car stops and eliminating lower landing starvation is by down peak sectoring. Sectoring provides a method of grouping the floors above the lobby into sectors. Sectors are sets of contiguous floors above the lobby. Only one car serves a sector at a time. Since sectors are subsections of the total number of floors in the building, the service range of a car within a sector is restricted. Once assigned to a sector, a car is restricted to serve downpeak demand only in that sector and floors below, ignoring floors above the assigned sector. Since, in a downpeak demand period, cars get loaded within their sector, traffic demand for different sectors is given equal priority. This causes an equal distribution of waiting times as well as service to every floor.

According to the present invention, during downpeak time period of an elevator system, cars are assigned to sectors of an approximately equal number of floors with remaining floors being assigned to sectors near the lobby, one car per sector.

BRIEF DESCRIPTION OF THE DRAWINGS

FIG. 2 is a flowchart for implementing downpeak sectoring.

BEST MODE EMBODIMENT FOR CARRYING OUT THE INVENTION

Figure 1:
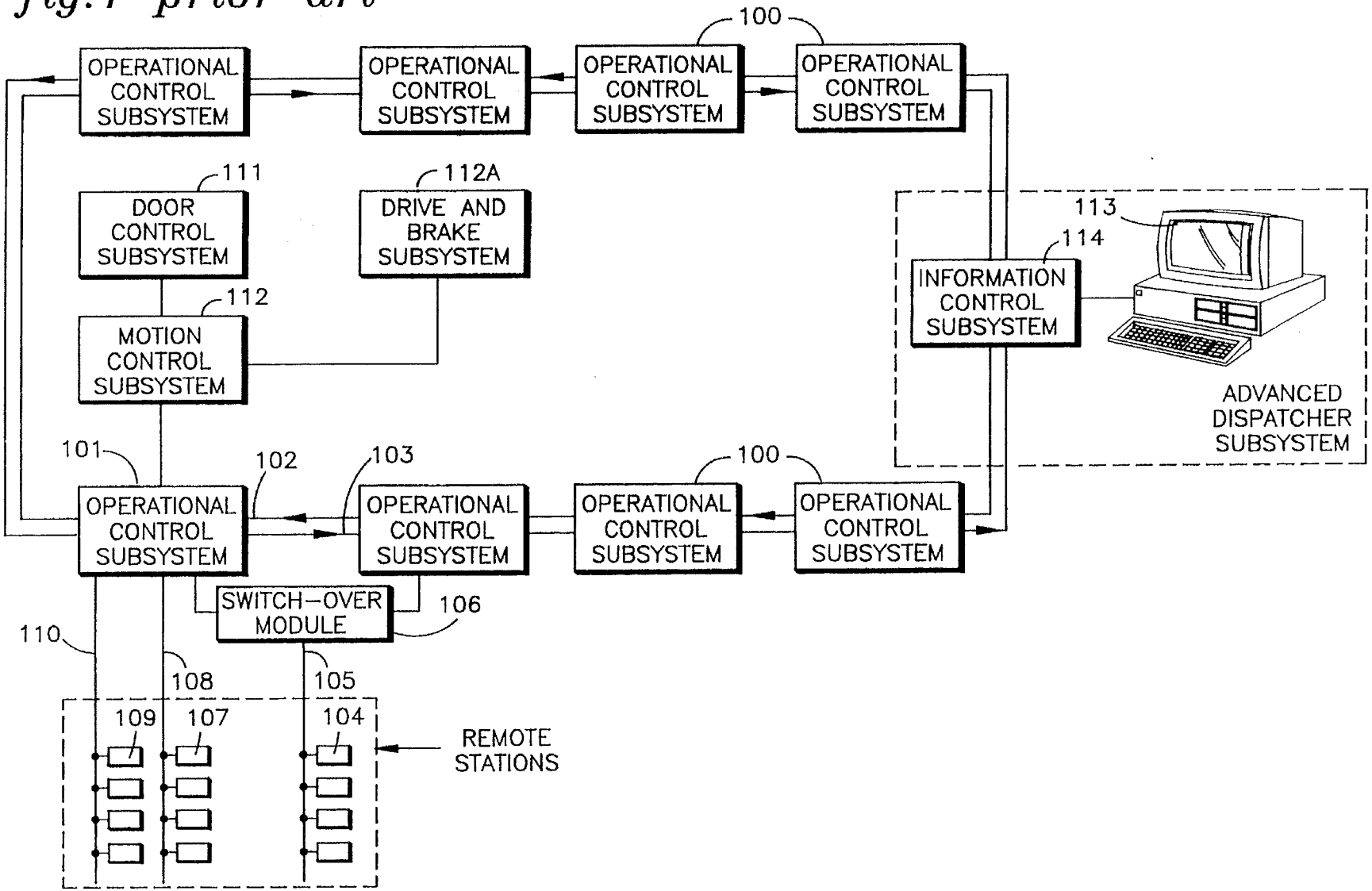
fig. 1 prior art
FIG. 1 is a block diagram of a ring elevator communications system for an 8 elevator car group.

FIG. 1 shows an eight car group, each car having one operational controller subsystem (OCSS) 101, one door control subsystem (DCSS) 111 and one motion control subsystem (MCSS) 112 and a drive brake subsystem 117. Such a system may be found in U.S. Pat. No. 5,202,540 entitled "Two-Way Ring Communication System for Elevator Group Control" by Auer and Jürgen. There are four microprocessor systems associated with every elevator. This system can collect data on demand throughout the day, by means of car call and hall call activations, for example, to arrive at a historical record of traffic demands for each day of the week and compare it to actual demand to adjust the overall dispatching sequences. Hall calls and car calls are read by an OCSS 101 associated with the car and then communicated to all OCSSs 101 via the ring communication system for computation of a relative system response(RSR), as described in "Relative System Response Call Assignments", U.S. Pat. No 4,323,142 to Bittar, incorporated herein by reference. Load weight in an elevator car is read by a motion control subsystem (MCSS) 112 and the maximum and minimum values of loadweight during a time interval are taken and communicated to an ADSS 113 via the OCSSs 101 and the ring communication system for conversion to boarding and deboarding counts.

There, the task of elevator dispatching may be distributed to separate microprocessor systems, one per car. These microprocessor systems, operational control subsystems (OCSS) 100, 101, are all connected together via two serial links (102, 103) in a two way ring communication system. FIG. 2 shows an eight car group configuration. For clarity purposes MCSS (112) and DCSS (111) are only shown in relation to a specific OCSS 101; however, it is to be understood that there would be eight sets of these systems, one set to correspond with each elevator.

Hall buttons and lights, i.e., the elevator group related fixtures as opposed to car related fixtures, are connected with remote stations 104 and remote serial communication links 105 to the OCSS 101 via a switch-over module (SOM) 106. The car buttons, lights and switches are connected through remote stations 107 and serial links 108 to the OCSS 101. Car specific hall features, such as car direction and position indicators, are connected through remote stations 109 and a remote serial link 110 to the OCSS 101.

The car load measurement is periodically read by a DCSS 111. This load is sent to MCSS 112. DCSS 111 and MCSS 112 are microprocessor systems controlling door operation and car motion under the control of the OCSS 101.

The dispatching function is executed by the OCSS 101, under the control of the advanced dispatcher subsystem 113, which communicates with the OCSS 101 via the information control subsystem (ICSS) 144.

In FIG. 2, sectors are calculated by an elevator control system based on the number of cars available for downpeak and the number of floors above the lobby. The number of sectors calculated is equal to the number of cars available for downpeak. The bounds of the sectors are calculated by partitioning the floors above the lobby into equal sized groups, distributing any remaining floors among the lower groups of floors. The remaining extra floors are distributed among the lower sectors because the round trip travel time for the lower sectors is smaller than for the sectors in the upper section of the building. Therefore, the lower sectors can service a larger traffic demand than upper sectors without a substantial penalty in waiting time for passengers. For example, if a building has 20 floors and three cars available, one sector includes 6 floors and the bottommost 2 sectors include 7 floors . Should the number of cars available for downpeak change, the sectors are resized.

A sector is assigned to a car based upon the age of the sector. A car needing a sector is assigned to the oldest sector not served by another car. Initially, the sectors are born from top to bottom, the top sector being the oldest and the bottom sector being the youngest. After birth, a sector ages until it is assigned to a car in the group. Once assigned, the sector is reborn and begins its life again. Thus, the last sector assigned is the youngest sector.

Once a sector is assigned, the car parks at the top of the sector if no demand exists within the sector or begins serving the highest down hall call within the sector if there is demand within the sector.

If a car parks within its sector without demand for a predetermined period of time, it is reassigned to a sector with demand that is not being served. This prevents sectors containing no demand from holding cars at bay.

When a car has traveled below its sector while making its down run, that sector is then available to the rest of the cars in the group for assignment.

A car is assigned a sector only when it has met its previous demand. This condition could be met at the lowest or the highest landing in its run. For a car traveling in the down direction with passengers, the lowest landing (during down-peak) is usually the lobby. And for the car traveling in the up direction (during down-peak) the highest landing would be at the last car call serviced.

If there is up demand and any car available, that is, not assigned to a sector, the car is assigned to serve the up demand. If the number of cars in the group is 4 or less, the number of cars assigned for up hall calls is one. A group with a greater number of cars has 2 cars that serve the up hall calls.

The assignment of a car to serve up hall calls only occurs when there are outstanding up hall calls. Cars are assigned to serve up demand one at a time. If no up hall call is present, then all cars are used for down call service.

Cars can be assigned to answer up hall calls or down hall calls. Down hall calls are served by the car assigned to the sector containing the floor of the call. Up hall calls, on the other hand, are not answered by any car serving the down demand. If all cars are assigned to sectors and serving the down demand within their sector, the up hall calls have to wait. Once a car has served its sector's demand and is ready for assignment to another sector, service to up hall calls is carried out as follows:

A. If there are up hall calls present in the system, and no car is assigned to answer any up hall call, then up hall call service has the highest priority.

B. If there are up hall calls present in the system, and there is one car (two in groups with more than 4 cars) assigned to answer the up hall calls and the car is not (or both are not) fully loaded, then select the next available down sector for service.

C. If there are up hall calls present in the system, and there is one car (or two in groups with more than 4 cars) assigned to answer the up hall calls and the car is (or both are) fully loaded, then select the up hall call service.

D. If there are up hall calls present in the system, and there are two cars (three in groups with more than 4 cars) assigned to answer the up hall, then select the next available sector for service.

Once a car serving the up hall calls reaches the highest point in its run, it waits a predetermined time before it is next assigned. This is so that other cars in the vicinity of the old sector, that are just about to complete their service demand, can be considered.

If (A) a car is assigned a sector and parked idle within its sector, and up hall calls appear, it gives up its sector to answer the up hall calls. If (B) there is more than one car with the idle status(parked), the car with the best RSR for serving the lowest up hall call is the one to give up its sector for up hall call service. Note that in either case (A),(B) the number of cars assigned to the up hall call service is limited (2 in 4 or less car groups, and 3 in 5 or greater car groups).

The flowchart of FIG. 2 is divided into two portions. The top is related to up hall call assignment and the bottom to down peak sectoring.

The flow chart of FIG. 2 is executed by each car available for service during down peak after initial conditions have been set. These conditions include initial assignment of cars to sectors, for example cars 1–4 are initially assigned contiguous nonoverlapping sectors 1–4 which each contain 5 floors , with sector 1 being the sector nearest the top of the building.

Downpeak may be determined by the time on a clock. For example, a time near the end of the work day, in the case of an office building, when traffic heading downward tends to be large. Downpeak may also be a function of the quantity of traffic heading in the down direction, or any other suitable method.

If an elevator system is not in down peak mode, test 2 is no, the down peak sectoring scheme in FIG. 2 is not executed. If there is no outstanding up hall call in the system, test 4 is no, the routine is ready for execution of the down peak sectoring portion of the routine of FIG. 2, beginning at step 6.

If there is an outstanding up hall call, test 4 is yes, and no car assigned to serve the up demand hall calls, test 8 is no, then a car is assigned to the hall call at step 10.

If there is an up hall call, test 4 is yes, and there is a car assigned to serve the demand, test 8 is yes, then the routine of FIG. 2 enters a series of steps directed toward making the best assignment to serve the up hall call. If one car is assigned, test 8 is yes, and not more than four cars in the group of cars available, test 12 is no, and there are four or fewer cars available for assignment to any call, 12 yes, and a first car not fully loaded assigned to serve the up demand, test 14 is yes and test 16 is no, that first car is allowed to serve the up hall call; but, if the first car is fully loaded, test 16 is yes, then a second car (this car) is assigned the up hall call when it is released from any assignment to a sector, 10.

If there is an up hall call, test 4 is yes, and there are more than four cars available for assignment to any call, test 12 is yes, either one or two cars, not fully loaded, are assigned to serve the up demand, test 18 is no and test 20 is no, either of the two may serve the up hall call; but, if both are fully loaded, test 20 is yes, then a third car (this car) is assigned the up hall call when it is released from any assignment to a sector.

If there is an up hall call, test 4 is yes, and there is a car assigned to serve the up demand, test 8 is yes, and four or fewer cars in the group, test 12 is no, and one of them is assigned to serve the up demand, test 14 is yes, if that car is fully loaded, test 16 is yes, then service of the up demand takes priority; but if that car is not fully loaded, test 14 is no, then the down peak sectoring portion of the routine of FIG. 2 is entered at step 6. If there is an up hall call, test 4 is yes, and there is a car assigned to serve the up demand, test 8 is yes, and more than four cars in the group, test 12 is yes, if there are three cars serving the up demand, test 18 is yes, the down peak sectoring portion is entered at step 6.

A car is assigned, that is signed up for, the oldest sector available, at steps 6 and 22. For determining age, when the down peak sectoring portion of the routine of FIG. 2 is to be executed, a car is signed up for a sector, that sector's age counter is initialized in steps, and a sector service time-out is initialized in steps 24, 26.

In FIG. 2, if there is no traffic in the sector, 28 no, and the sector service time-out exceeds a selectable, predetermined limit, test 30 is yes, and the sector is released in step 32 so that the car can serve elsewhere.

If there is no traffic in the sector, test 28 is no, but the sector time-out has not exceeded the limit, test 30 is no, the car assigned to that sector goes to the topmost floor and parks there in step 34.

If there is traffic in the sector, test 28 is yes, then the car goes to the top most floor in the sector having down demand in step 38 and serves the demands of that sector, in steps and tests 40 42, 44, until the lowest most floor in the sector has been served, test 36 is yes, at which point the sector is released in step 32.

Various changes may be made herein without departing from the invention.

We claim:

1. A method of dispatching a plurality of elevator cars operating as a group in a building during a down peak mode of operation, comprising:

assigning floors of said building to sectors of contiguous floors; and assigning one of said cars to one of said sectors for responding to down hall calls in said sector;

characterized by the improvement comprising:

upon assigning said car to said one sector, initiating an age counter for said one sector; and said assigning step comprises assigning said car to the one of said sectors, that does not have a car assigned to it, for which the time since it last had a car assigned to it is the longest, as indicated by said age counter.

2. A method of dispatching a plurality of elevator cars operating as a group in a building during a down peak mode of operation, comprising:

assigning of said building to sectors of contiguous floors;

for each one of said cars, determining if there is any unanswered up hall call outstanding in the building, and if there is, determining if there is a car assigned to serve up demand and if there is not a car assigned to serve up demand, causing said one car to serve up demand, but if said one car is not assigned to serve up demand, assigning said one car to one of said sectors for responding to down hall calls; and dispatching said cars to serve hall calls in said building.

3. A method according to claim 2 wherein:

if there is not more than a given number of cars assigned to serve up demand, but said cars assigned to serve up demand are full, assigning said one car to serve up demand.

4. A method according to claim 3 wherein said given number is one.

5. A method according to claim 3 wherein said given number is two.

* * * * *